United States Patent [19]

Leonard

[11] Patent Number: 4,670,940

[45] Date of Patent: Jun. 9, 1987

[54] TORSION SPRING MOUNTING STRUCTURE

[75] Inventor: George H. Leonard, Darien, Conn.

[73] Assignee: Airpot Corporation, Norwalk, Conn.

[21] Appl. No.: 857,367

[22] Filed: Apr. 30, 1986

Related U.S. Application Data

[60] Division of Ser. No. 722,754, Apr. 12, 1985, which is a continuation-in-part of Ser. No. 696,344, Jan. 30, 1985.

[51] Int. Cl.[4] ..... E05F 1/08

[52] U.S. Cl. ..... 16/308; 16/300; 16/75

[58] Field of Search ..... 16/299, 300, 301, 308, 16/50, 75, DIG. 36, 354; 403/1, 24, 111, 350, 397; 267/57, 154

[56] References Cited

U.S. PATENT DOCUMENTS

| | | | |
|---|---|---|---|
| 3,615,081 | 10/1971 | Ravenel | 267/57 |
| 4,571,775 | 2/1986 | Leonard | 16/308 |
| 4,589,164 | 5/1986 | Leonard | 16/299 |
| 4,591,136 | 5/1986 | Leonard | 267/57 |

FOREIGN PATENT DOCUMENTS

| | | | |
|---|---|---|---|
| 141822 | 6/1980 | Fed. Rep. of Germany | 16/75 |
| 3023950 | 1/1982 | Fed. Rep. of Germany | 16/308 |
| 2121101 | 12/1983 | United Kingdom | 16/308 |

*Primary Examiner*—Nicholas P. Godici
*Assistant Examiner*—G. M. Reid
*Attorney, Agent, or Firm*—James & Franklin

[57] ABSTRACT

A torsion bar assembly such as may be used to provide a counterbalancing force active on a part movable with respect to a second part is mounted on one of those parts by a structure which permits the torsion spring unit to be readily moved into position with its operative parts in desired rotational position relative to one another as well as to the parts with which they are to be used. The mounting structure is provided with a recess with inwardly projecting teeth and the torsion unit has externally projecting teeth. A part is substantially parallel to those teeth. A clip is designed to be a part of the assembly, hold the parts of the assembly in desired rotational relationship, and ensure that the assembly is mounted in proper rotational position.

11 Claims, 21 Drawing Figures

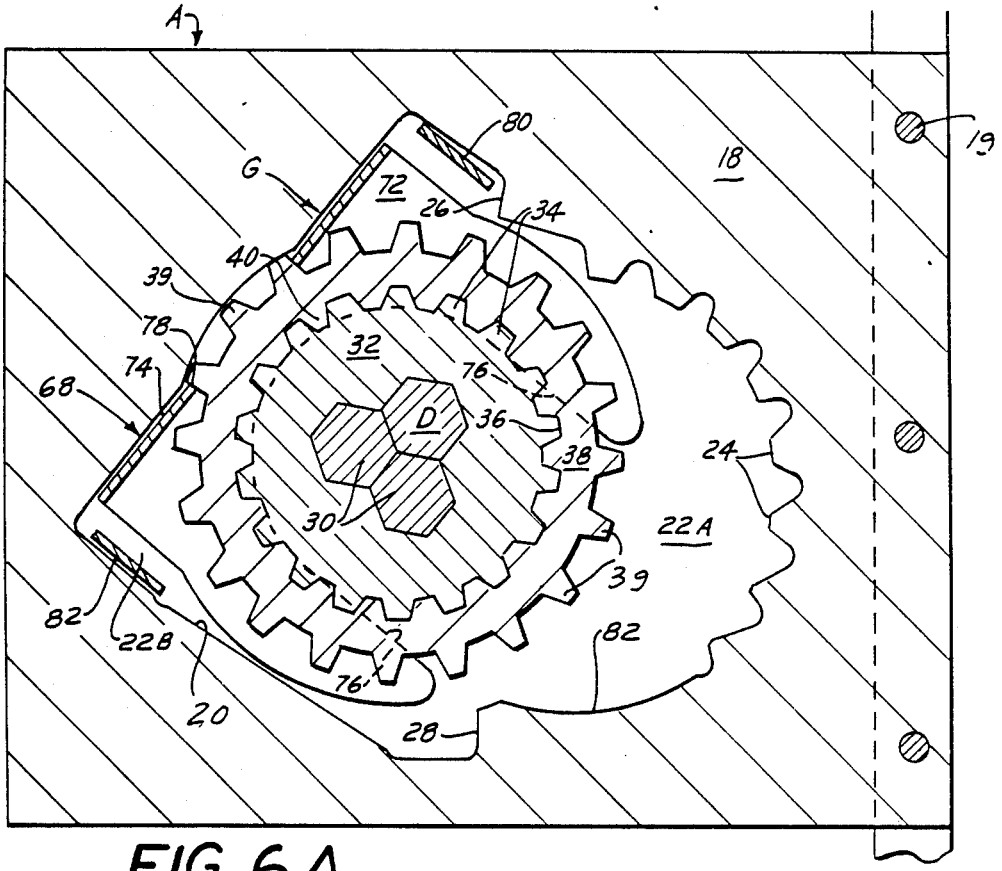
FIG. 6A
FIG. 6B
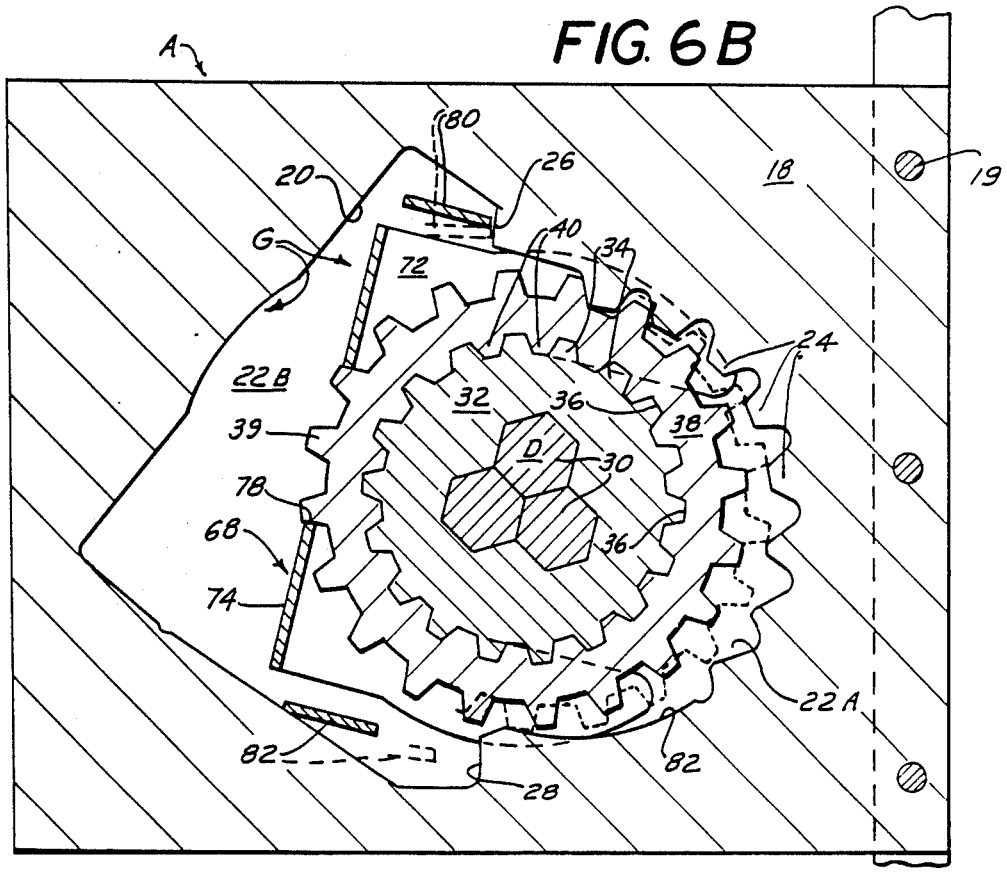

TORSION SPRING MOUNTING STRUCTURE

This application is a division of my application Ser. No. 722,754 filed Apr. 12, 1985, which is turn a continuation-in-part of my application Ser. No. 696,344 filed Jan. 30, 1985.

The present invention relates to means for mounting a variable tension device which is effective to act between two parts articulately movable relative to one another, and is here specifically disclosed in connection with such a device in which the variable tension is achieved through the twisting of a torsion element. In particular it relates to such mounting means which permits the variable tension device to be readily mounted and dismounted, and in which the relative rotational positions of the variable tension device and its relevant parts are fixedly maintained when the device is mounted.

Variable tension devices using torsion members are used in many different circumstances. One such use, involving a composite bar torsion element, is disclosed in my copending application, Ser. No. 618,897 of June 8, 1984, entitled "Variable Tension Device", assigned to the assignee of this application, now U.S. Pat. No. 4,589,164. The structure of the present invention will be here specifically described in connection with a counterbalance device of that type, but it will be understood that in its broader aspects the invention is suitable for use with specifically different structures and in many other environments.

Counterbalance devices of the type used to illustrate the applicability of the device in the present invention are employed where one part is articulately connected to another so as to be movable between first and second positions, the nature of that part being such that its effective weight varies as it thus moves. For example, when a heavy lid is lifted from a horizontal position to a vertical position, it seems heaviest at the beginning of that movement and its effective weight decreases as it moves toward its vertical open position. Hence the force necessary to move it is greatest when the lid is horizontal and least when the lid is vertical, thus creating a tendency to slam the lid into its vertical position and also, because of the effective weight of the lid, tending to cause the lid to slam into its horizontal position. In addition, under normal circumstances, if the lid is released in an intermediate position it will tend to fall back to its horizontal position, usually with considerable force. Consequently, counterbalance devices are employed which are effective to minimize the differences in apparent weight of the lid as it moves from one operative position to the other, and preferably effective to exert a force on the lid at any given intermediate position which is substantially equal and opposite to the force that the lid would normally exert, so that if the lid is released in an intermediate position it will tend to stay in that position.

Actual physical counterbalancing by means of an added and appropriately located weight involves significant problems of weight, space, cost and safety. Therefore many different artificial counterbalancing devices have been proposed, but few if any can produce perfect or neutral counterbalancing (by neutral counterbalancing is meant counterbalancing such that the lid will remain in whatever position it finds itself, and will exert a smooth, low resistance to movement from that position) without complex and expensive structure, and most take up a significant amount of space and add significant weight to the overall construction. Many such devices utilize hydraulic or pneumatic cylinders, which are subject to significant maintenance problems. Springs, including torsion springs, have been used in the past for this purpose, but they either are extremely bulky, heavy and expensive or they can be used only for relatively light work. Even the bulkiest spring hinge becomes unsuitable when truly heavy lids are involved, and for such heavy lids the art has turned to the use of hydraulic shock absorbers or gas springs, but they are significantly more costly, present very substantial space problems, and obstruct side access when the lid is lifted.

Moreover, torsion spring assemblies as used in the past have involved structures individually designed for a particular application. When a new application calling for even a slightly different torsion characteristic is presented, a new and different structure must be designed for that purpose. This adds greatly to the cost of such devices. Moreover, adjustability of such structures, to accommodate external or internal changes or to make a given structure adaptable for use in a plurality of environments, is difficult and unreliable.

Different applications often present different problems to the variable tension device. In one instance the element to be counterbalanced may rotate through 180°, while in another instance that element may only rotate through 90°. When rotation through more than 90° is required, counterbalancing in opposite directions for different rotational positions may be called for. Raised positions for the lid or other element to be counterbalanced may vary widely from installation to installation. Lids may be at rest when horizontal, inclined, vertical or combinations of these positions. In order for a variable tension device of standard construction to be effective in all of these instances, the initial rotative anchor position of the end of the torsion element adapted to be secured to the relatively fixed support is very important; it must be adjustable, and with a reasonable degree of precision. Although the lid or other movable element may be rotated through 90° or more, the torsion element is usually twisted through a much smaller angle, such as 40°, thus emphasizing the criticality of initial anchoring position.

The structure disclosed in the aforementioned application Ser. No. 618,897 was quite effective in achieving its desired objective, and in particular in providing for adjustability of the torsion effect produced thereby, particularly with respect to effective setting of the initial rotative anchor position. In that structure (and in the device here specifically disclosed) the initial rotative position of the torsion element was determined by controlling the relative rotational position of a pair of meshing gears. Since the torsion unit is manufactured remote from its point of use and then shipped to the location where the apparatus with which it is to be associated is located, there to be mounted on that apparatus, it is essential that the relative rotational position of those meshed gears remain intact during the shipment of the torsion device and during the actual mounting of that device on the apparatus in question. Only if this is done can the apparatus be readily installed when received, something that is, as a practical matter, commercially essential. Moreover, when the torsion device is mounted on its associated apparatus its rotational position relative to that apparatus must be proper if the device is to function as designed. These requirements, in the structure of the earlier application, called for a special, somewhat complex and expensive structure within the torsion device to maintain the gears in proper relationship and presented troublesome problems in connection with the mounting of the devices on the apparatus, all of which were a source of trouble and expense.

Mounting of the prior art torsion devices on a relevant piece of apparatus generally involved providing fixed structural elements between which the torsion element was snugly received, the torsion element thereafter being held in place by means of screws. This mounting arrangement required the forming of screw holes in both the mounting part and the torsion element, the insertion of the torsion element into a confined space, and its subsequent movement to bring the screw holes into registration, all of which was a cause of some expenditure of time and trouble, particularly since the device was often mounted in locations of difficult accessibility.

It is the prime object of the present invention to provide a mounting means for a torsion element which greatly facilitates the mounting of that element on the apparatus with which it is to be associated.

It is another object of the present invention to provide such a mounting means by sturdy, reliable, simple and inexpensive yet highly efficient structures.

It is a further object of the present invention to provide such a mounting means which enables the torsion device to be mounted merely by moving it into position, and without requiring screws or other extraneous fastening devices.

It is yet another object of the present invention to devise such a construction which ensures that the torsion element, when mounted on the apparatus, is in a predetermined desired rotational position relative to that apparatus.

It is a still further object of the present invention to simplify and reduce the cost of the parts needed to attain and maintain the desired rotational position of all parts of the mounted assembly.

It is yet another object of the present invention to devise such a construction for a torsion device in which the internal parts are to be assembled in predetermined relative rotational positions, there to remain until and after the device is mounted on its associated apparatus, the mounting structure ensuring that the internal parts of the torsion device, when adjusted, will reliably retain their adjusted position during shipment, installation and actual use.

In accordance with the present invention, the above and related objects are collectively achieved by providing the mounting structure with a recess or opening (hereinafter generally referred to as "recess") with inwardly projecting teeth, the recess being so sized and shaped that the torsion device assembly can be freely inserted therein, preferably in an axial direction. In one embodiment the torsion assembly is provided with externally projecting teeth adapted to be brought opposite the said internally projecting teeth during the initial pre-insertion of the torsion assembly into the recess and then being adapted to be moved into meshing engagement with the inwardly projecting teeth through movement of the torsion unit in a direction generally perpendicular to its axis, and preferably by a rotating or swinging action. The teeth mesh, and thus fix the relative rotational position of the torsion element with respect to the mounting structure. The tension of the torsion element when it is operatively connected to its associated apparatus maintains the parts in fixed engagement.

In another embodiment the recess in the mounting structure has one or more gaps in its toothed area, and a part of the torsion assembly is inserted betweeen adjacent externally projecting teeth of that torsion assembly, thereby to mate with the gap in the mounting structure. The torsion element may be provided with a part non-rotatively fixed thereto in the course of the assembly of the unit which cooperates with the mounting structure so as to ensure that the rotative position of the mounted torsion element relative to that mounting structure is proper. That same part may also function, when the torsion element includes internal parts the relative rotational position of which is fixed and maintained, to ensure that those parts remain in proper relative rotational position.

More specifically, in the specific embodiment here illustrated, as in the embodiment illustrated in application Ser. No. 618,897, the torsion member is surrounded by a sleeve rotatable relative thereto. As here disclosed, that sleeve is provided with axially extending outer and inner protrusions, as by being fluted. The means which connects the sleeve to the external object mates with the external flutes of the sleeve, thereby to be adjustably axially positionable along the sleeve and to have a plurality of fixed rotatable positions relative to the sleeve but to be rotatable with the sleeve. The end of the torsion member is provided with a toothed element which is received within a ring having internal teeth and external teeth, preferably of different pitches, and the external teeth on that ring are designed to mesh with the internal teeth formed in the supporting structure. The relative rotational position of the toothed element carried by the torsion member and the ring which surrounds it, and the relative rotational position of that ring with respect to the internally toothed mounting structure, control the initial rotative, and hence torsional, condition of the torsion member. In one embodiment the torsion member is provided with a retainer or clip which engages with the external teeth on the ring, thus fixing the relative rotational position of the retainer with respect to the torsion member, and that retainer is provided with parts which engage cooperating parts on the mounting structure, thereby to ensure proper relative rotational positions of all parts when the torsion member is mounted. The retainer also engages the toothed element and the surrounding ring and retains them in meshing engagement. In another embodiment the torsion assembly is provided with a ring having a projecting finger which extends between two of the external teeth on the torsion assembly and which also engages the ring carrying those teeth to hold it in place on the torsion assembly, the finger and the external teeth between which the finger is received mating with the gap formed in the external teeth on the mounting structure, that ring therefore both engaging the toothed element and the surrounding ring to maintain them in meshing engagement and determining the relative rotative position of the torsion assembly with respect to the mounting structure.

As a result, when a given torsion member is manufactured the toothed element and surrounding ring are properly meshed, the retainer is put in place at an appropriate position on the member, and the torsion member with retainer attached is shipped to the location where the apparatus with which it is to be associated is located. The combined torsion member and retainer is then simply moved into engagement with the specially designed mounting structure, where it remains in mounted, properly rotatively adjusted position.

To the accomplishment of the above, and to such other objects as may hereinafter appear, the present invention relates to a torsion bar assembly and mounting means therefor as defined in the appended claims, and as described in this specification, taken together with the accompanying drawings in which:

Figure 3:
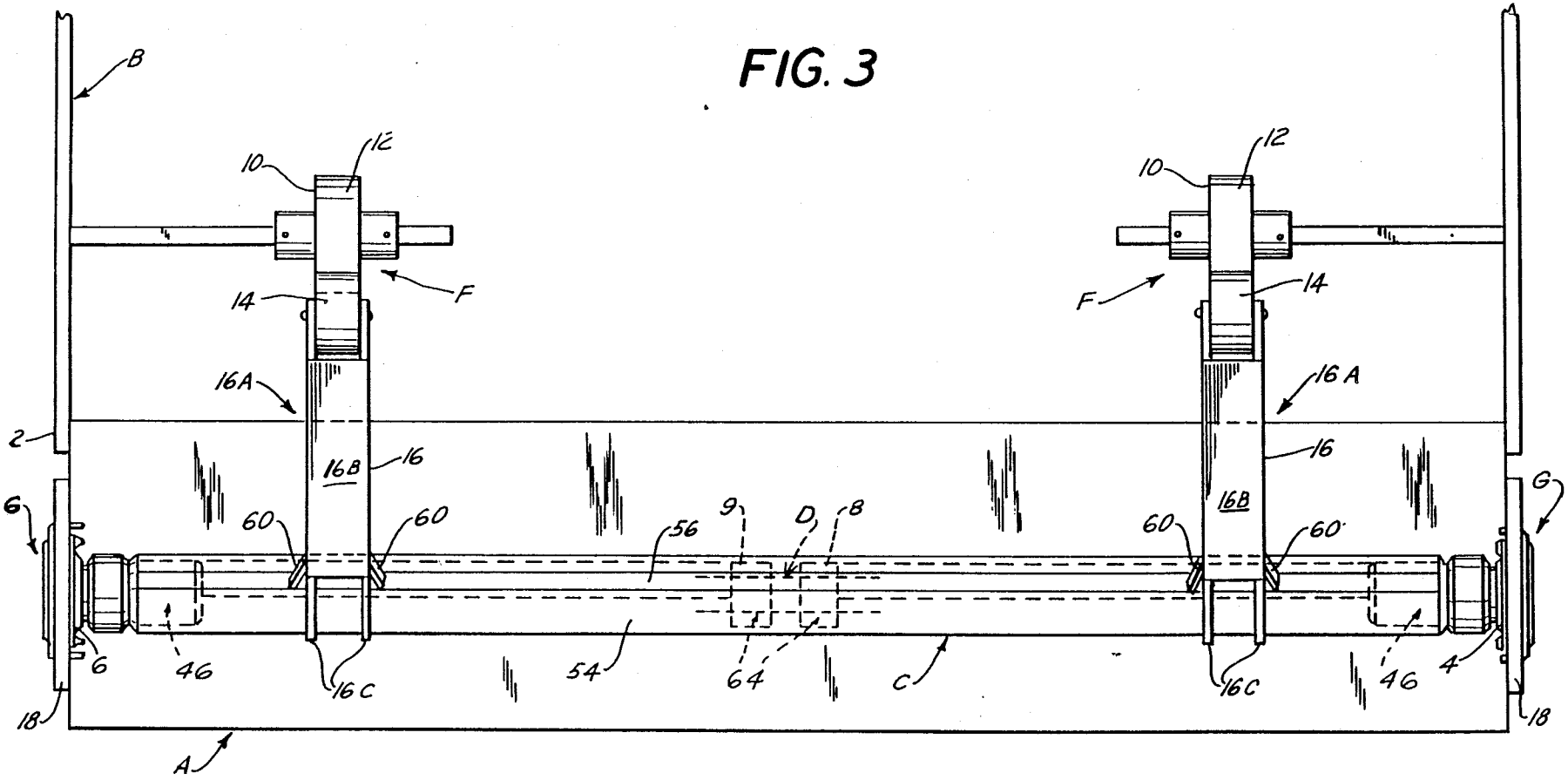
FIG. 3 is a front elevational view of the torsion bar assembly of FIG. 1 and its mounting structure.
Figure 4:
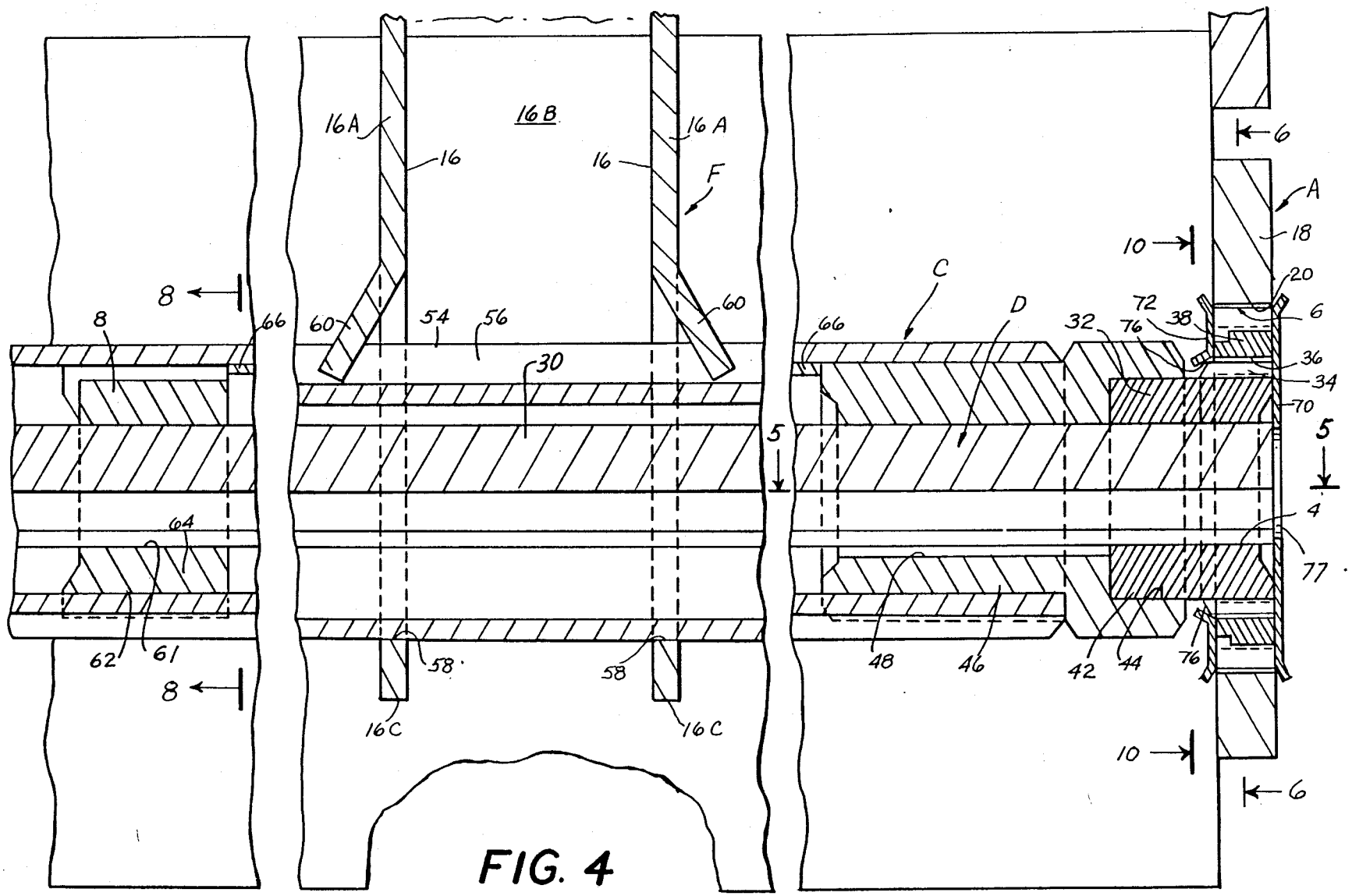
FIG. 4 is a fragmentary longitudinal cross-sectional view of the right-hand portion of the assembly of FIG. 3.
Figure 5:
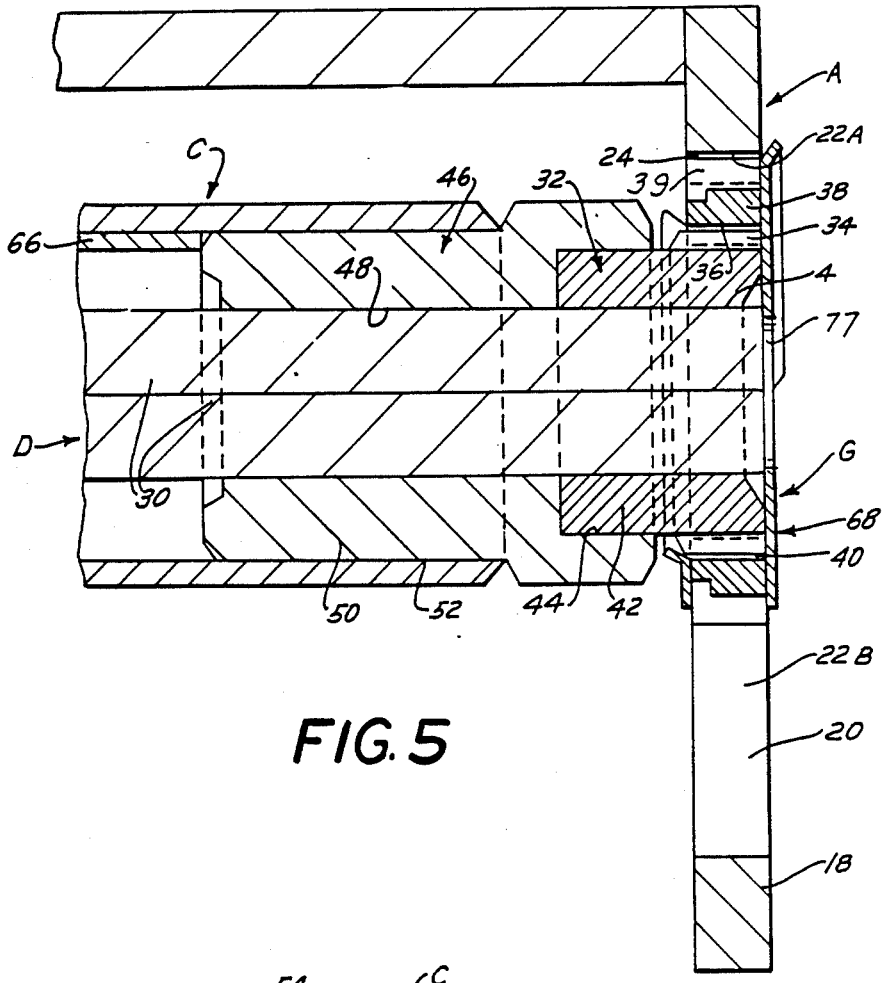
FIG. 5 is a cross-sectional view taken along the line 5—5 of FIG. 4.
Figure 8:
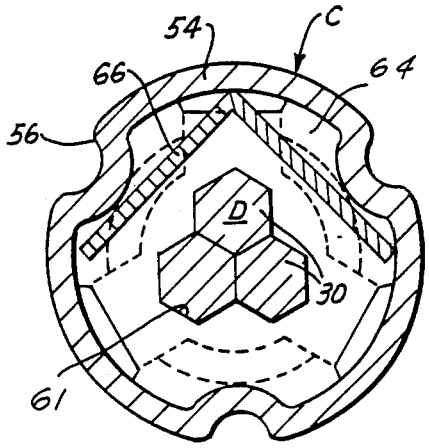
Figure 6C:
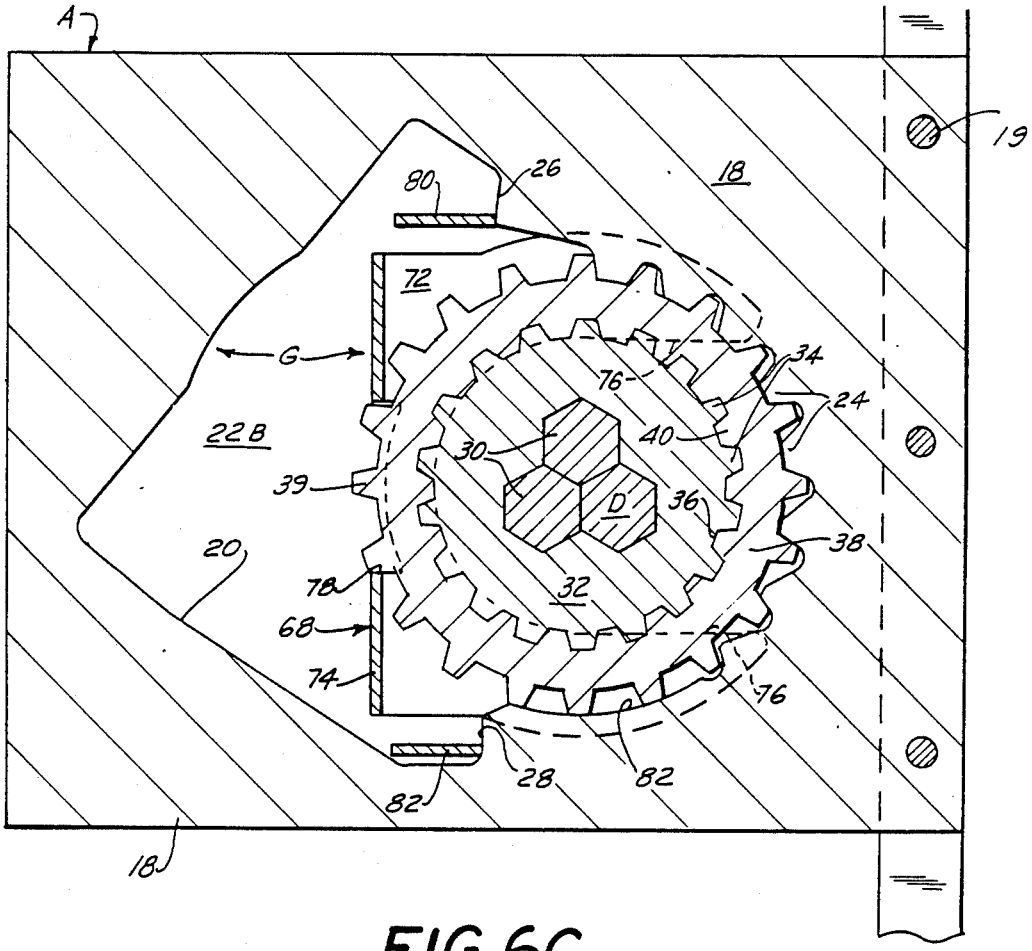
Figure 7:
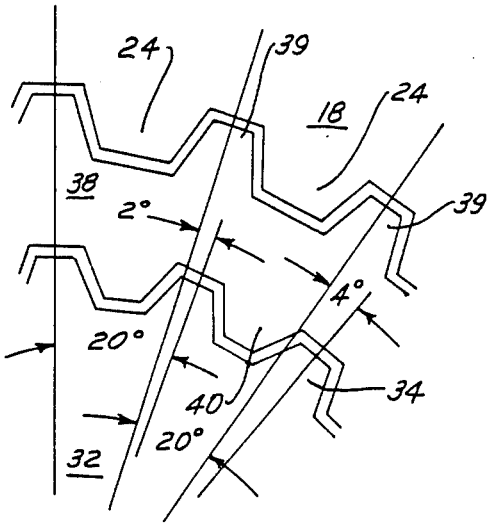
Figure 10:
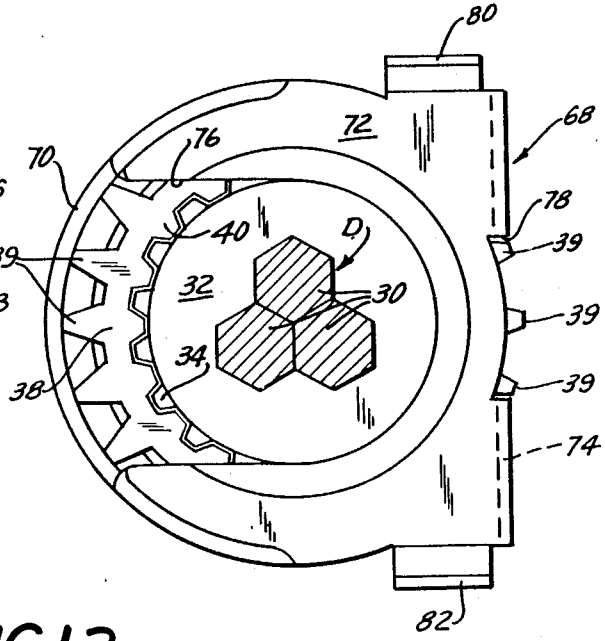
Figure 11:
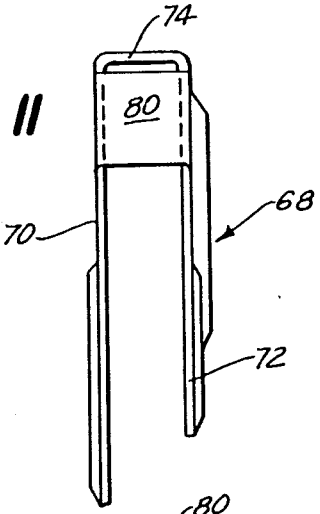
Figure 12:
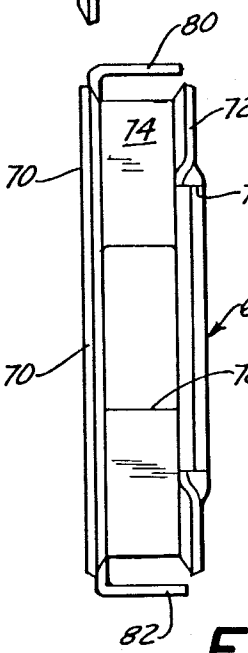
Figure 9:
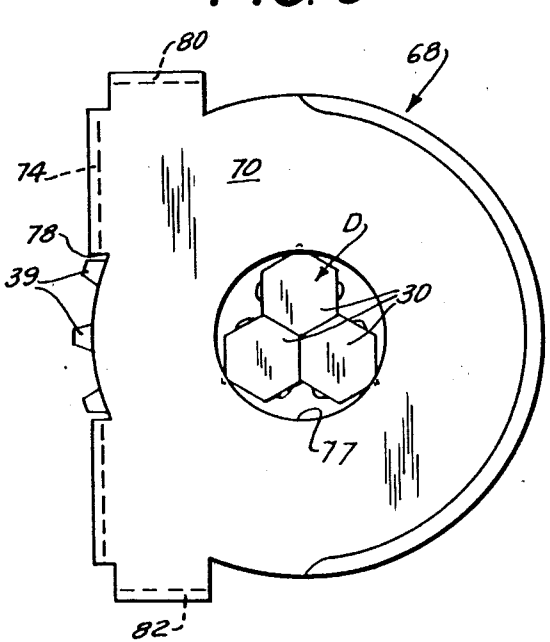
Figures 13, 14:
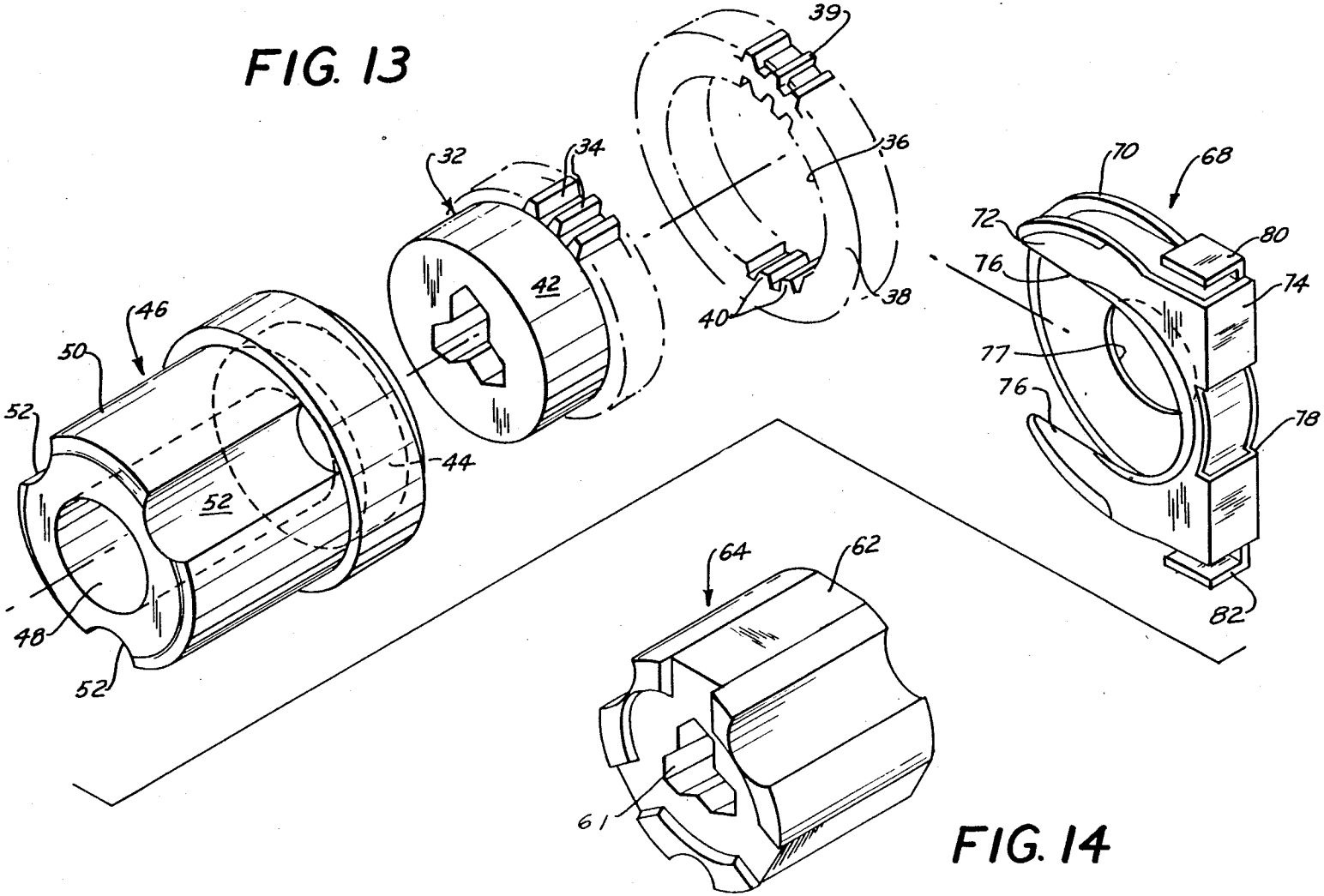
Figure 15:
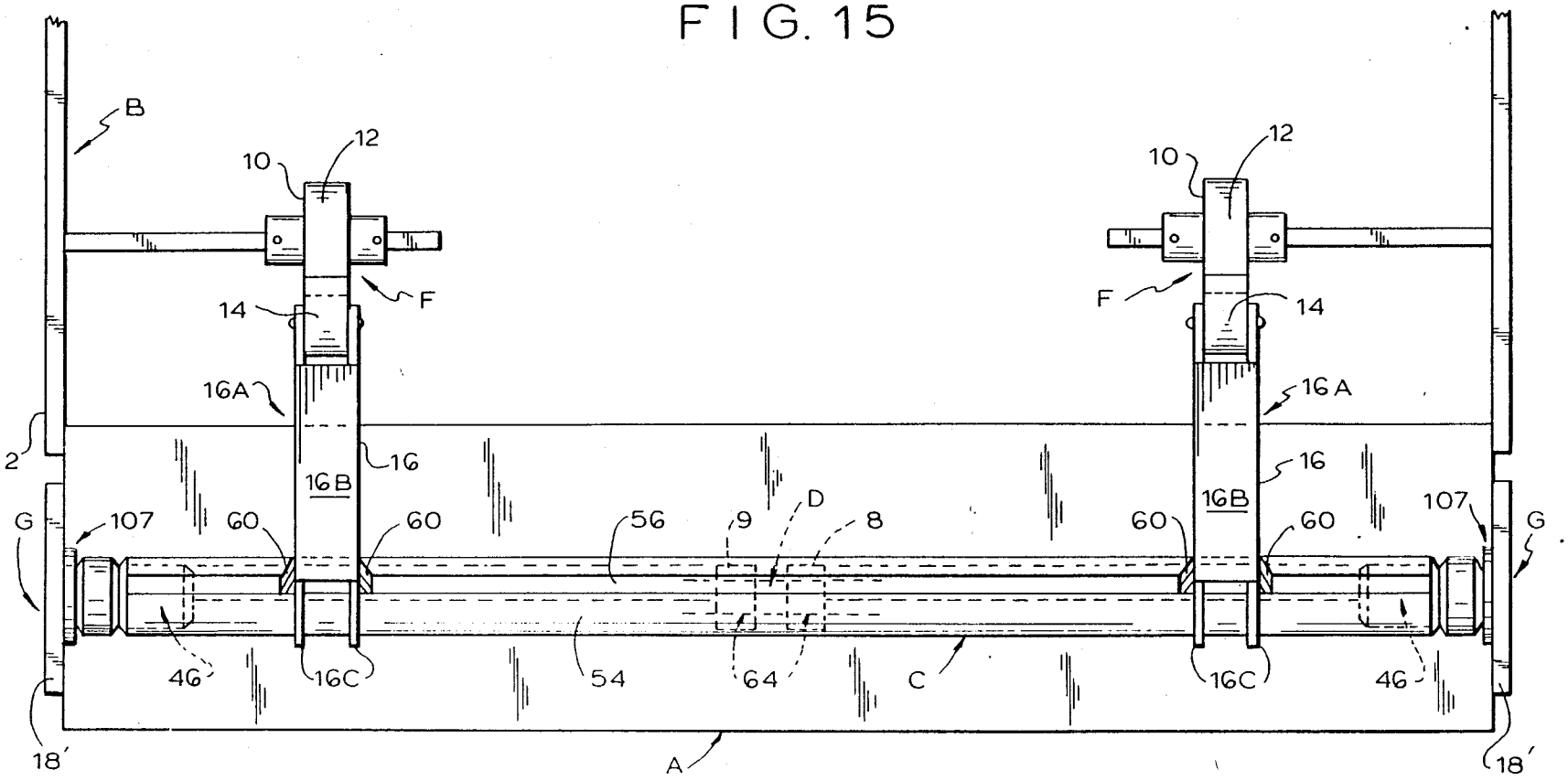
Figure 16:
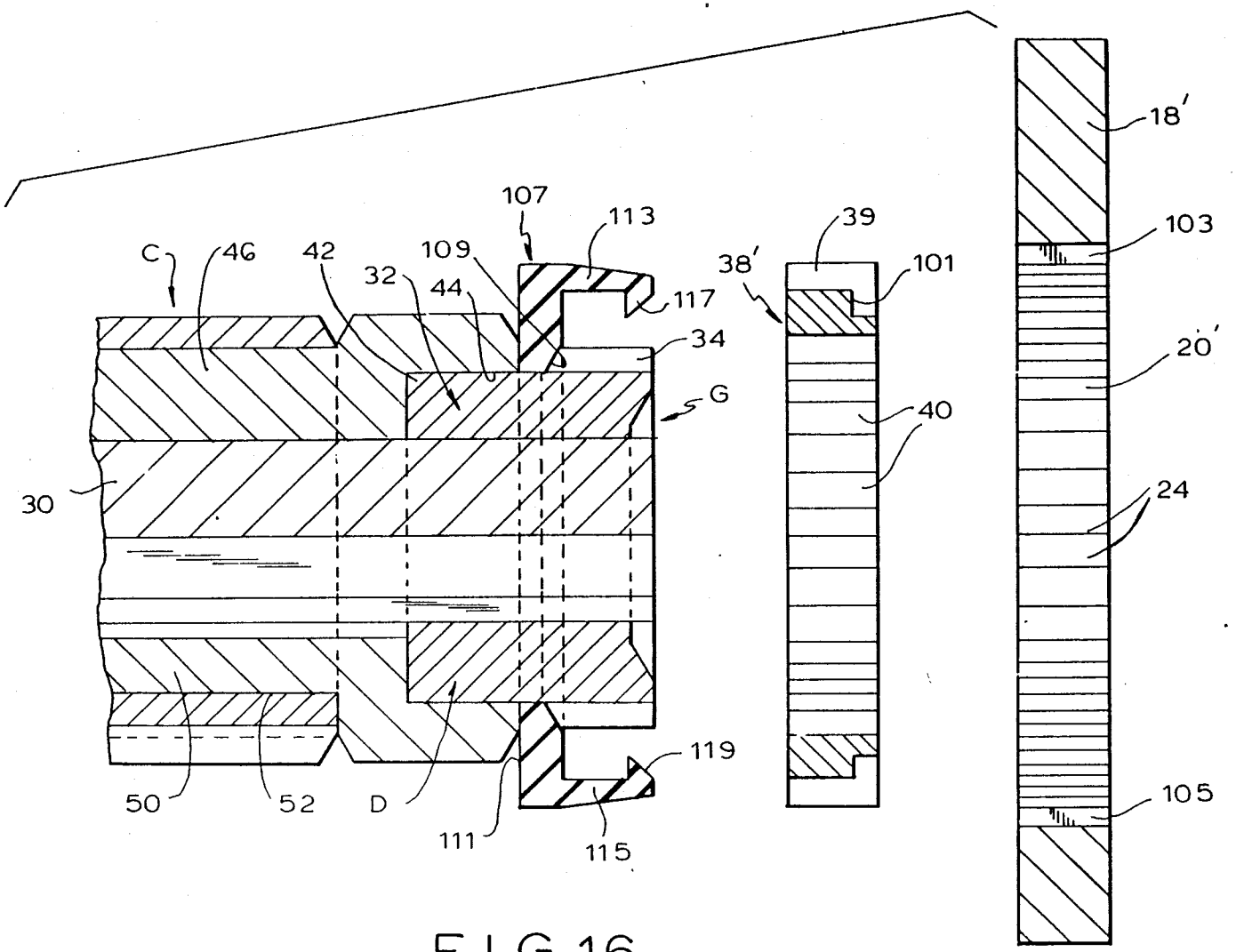
Figure 17:
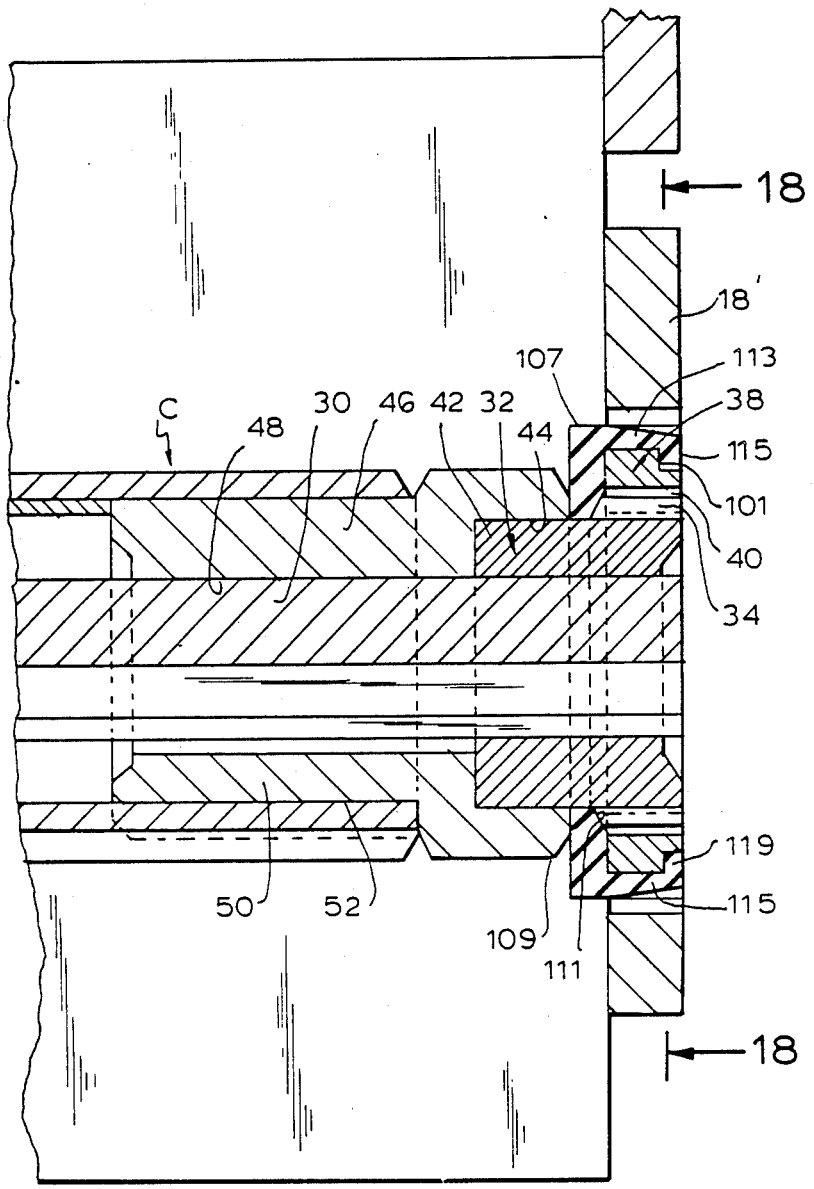
Figure 18:
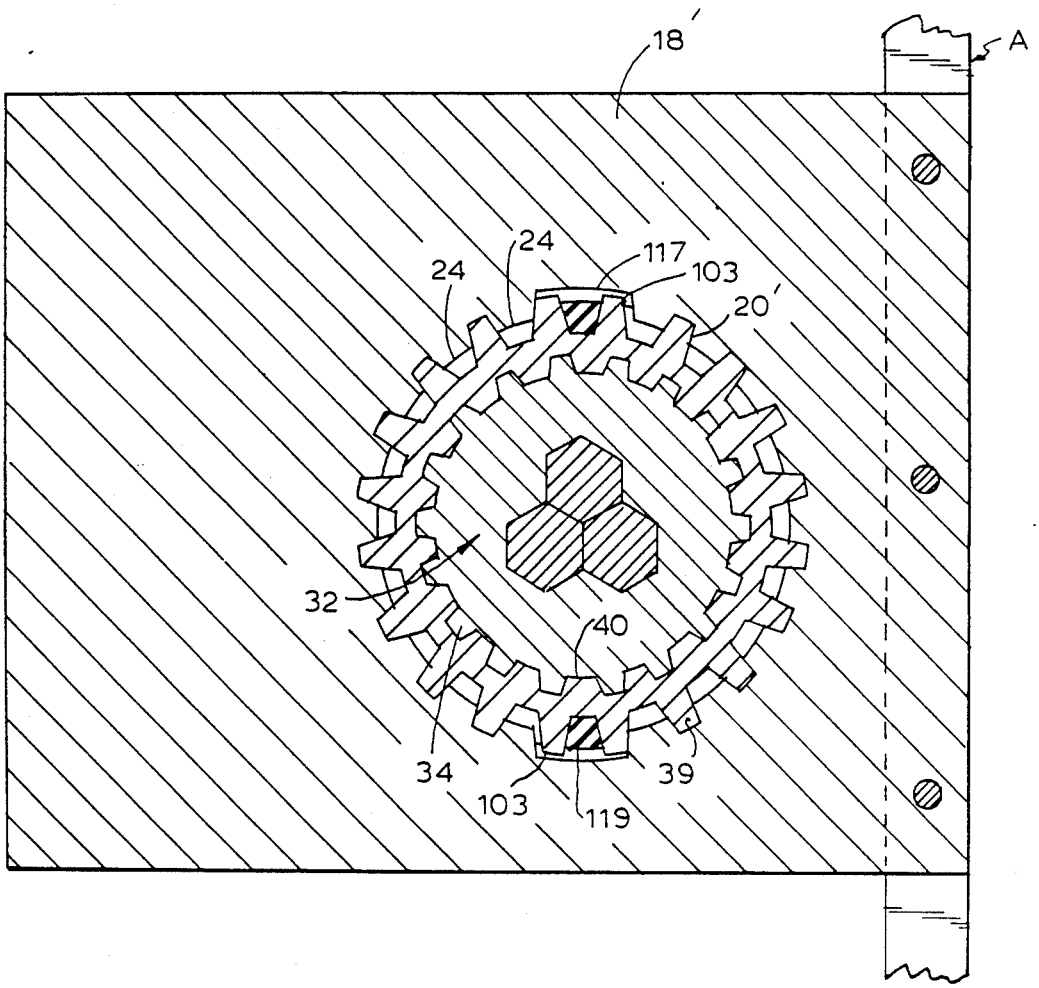
Figure 19:
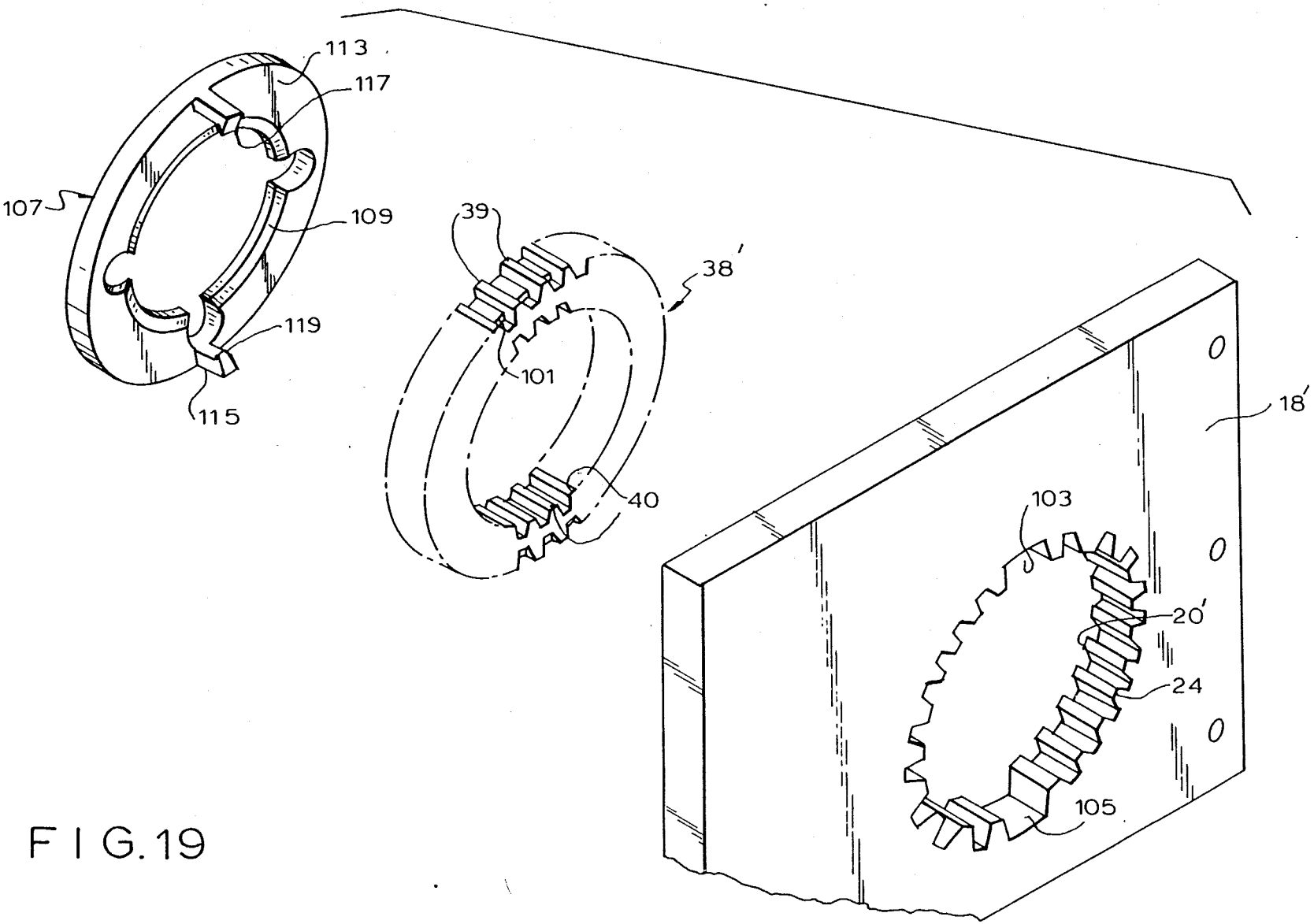

FIG. 6A–C are sequential cross-sectional views, taken along the line 6—6 of FIG. 4, showing the way in which the torsion member, once initially inserted into the recess or opening in the mounting structure therefor, is moved into mounting position;

FIG. 7 is a diagrammatic view illustrating the different pitches of the sets of gear teeth on the geared parts disclosed in FIG. 6;

FIG. 8 is a cross-sectional view taken along the line 8—8 of FIG. 4;

FIG. 9 is an end elevational view of the unmounted torsion member with the retainer in position thereon;

FIG. 10 is a cross-sectional view taken along the line 10—10 of FIG. 4;

FIG. 11 is a top plan view of the retaining clip;

FIG. 12 is an end elevational view of the retaining clip taken from the lower end of FIG. 11;

FIG. 13 is an exploded perspective view of the retaining clip and the parts with which it is associated; and FIG. 14 is a three-quarter perspective view of the part which connects the outer sleeve to the torsion element at a point remote from the end thereof;

FIG. 15 is a front elevational view similar to FIG. 3 but showing a second embodiment of the present invention;

FIG. 16 is a fragmentary exploded longitudinal cross-sectional view, on an enlarged scale, of the right-hand portion of the assembly of FIG. 15;

FIG. 17 is a fragmentary longitudinal cross-sectional view of the right-hand portion of the assembly of FIG. 15 with the torsion member engaged with the mounting structure;

FIG. 18 is a cross-sectional view taken along the line 18—18 of FIG. 17; and FIG. 19 is a three-quarter perspective view of the retaining ring and outer geared ring and the cooperatng mounting structure of the embodiment of FIG. 15.

Figure 1:
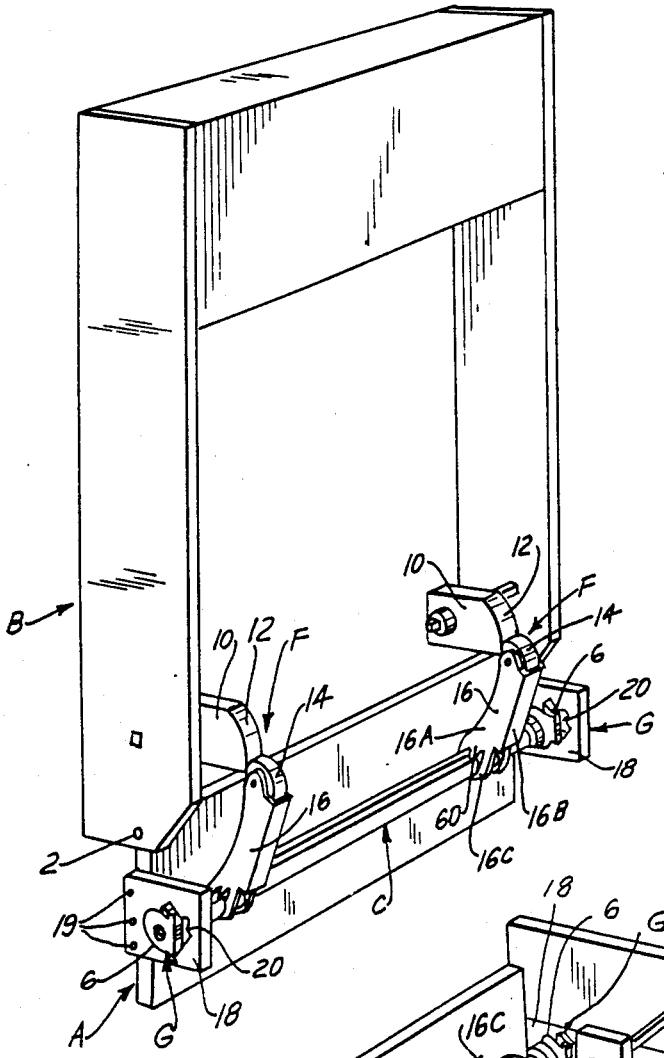
FIG. 1 is a three-quarter perspective view of a counterbalance device embodying the mounting structure of the present invention, which counterbalance device is so mounted as to be active on a pivotable external part, the part being shown in vertical position.
Figure 2:
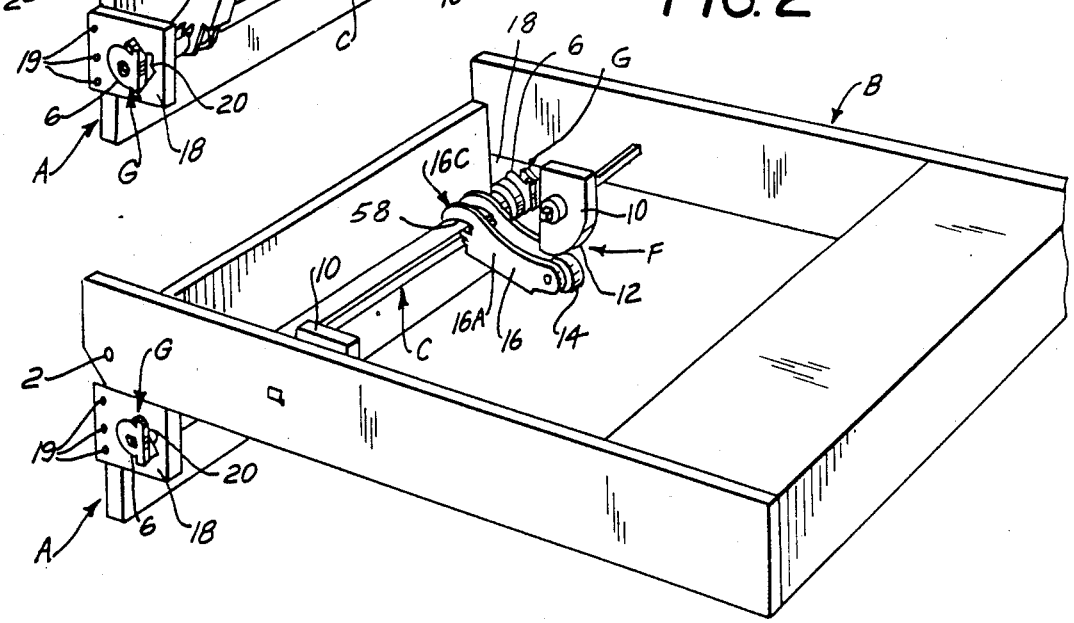
FIG. 2 is a view similar to FIG. 1 but showing the part in horizontal position.

The variable tension device of the present invention, as has been indicated, is here specifically disclosed in an environment where it is designed to counterbalance two articulating connected parts generally designated A and B, here shown more or less generically because of the wide variation possible in the nature of those parts. Part A is the fixed part, and part B is the movable part which is to be counterbalanced. Part B is pivotally connected to part A by pivot axis or shaft 2 to move between a horizontal position corresponding to a closed lid and a vertical position corresponding to an open lid (FIGS. 2 and 1 respectively). A portion of part B is made open so that the counterbalance device can be seen when the part B is in its horizontal position. Part B may be of appreciable weight. When it is in its vertical position shown in FIG. 1 that weight is wholly carried by the shaft 2, so little or no force is required to move the lid from its vertical position, but when the lid is in its horizontal position, as shown in FIG. 2, its weight acts downwardly at points remote from the shaft 2, so that a considerable amount of force is required to lift it. As the lid B is moved from its horizontal to its vertical position, the amount of force required to move it will progressively decrease, according to the cosine of the angle through which it is moved. What is desired is to counterbalance the part B, so that it will tend to remain in whatever position it may be placed, the counterbalancing force equalling and opposing the effective weight of the part B for that particular position.

The variable tension device of the present invention comprises an elongated torsion member generally designated D which, in the balanced or symmetrical form shown, is non-rotatably secured adjacent to its ends, at points generally designated 4 and 6 respectively, to the fixed part A. The torsion member D is surrounded by a sleeve generally designated C, which is rotatable relative to the fixed part A generally independently of the torsion member D but which is non-rotatably secured to the torsion member D at points 8 and 9 spaced, preferably equidistantly, from the points 4 and 6 respectively. Such rotation of the sleeve C with respect to the fixed support A will twist those lengths of the torsion member D between the points 4 and 8 and the points 6 and 9 respectively, and that torsion member will therefore exert a restraining force at least roughly proportional to the degree to which it is twisted.

A cam-follower combination generally designated F is provided, one part of which is secured to the sleeve C and the other part which is secured to the part B. As here disclosed the part B carries a cam 10 having a cam surface 12 over which a cam follower 14 rides, the cam follower 14 being mounted on the sleeve C by means of arm 16. Because of the desired symmetrical or balanced nature of the construction shown, two sets of cam-follower combinations F are provided, one near each end of the sleeve C. The cam mounting shown is illustrative only. The cam surface 12 may be configured to provide, within limits, a wide variety of different position-spring action relationships, i.e., detenting, balancing, biasing in one direction or the other, etc.

At each end of the torsion member D an adjustable mounting structure generally designated G is provided, by means of which the ends of the torsion member D may be fixed to the part A in any one of a plurality of desired rotative anchor positions. As here specifically disclosed, for the fixed part of that mounting structure the part A defining the support for the device is provided with a mounting block 18 extending out from the part A and secured thereto by means of screws or the like 19. That mounting block 18 is provided with a recess 20 the shape of which can perhaps best be seen in FIGS. 6A–C. It includes an approximately semicircular section 22A communicating with an approximately triangular section 22B. The section 22A is provided with internally extending teeth 24 of non-uniform shape, the upper teeth 24 being normal and the lower teeth 24 being reduced in size, preferably progressively, for a reason hereinafter explained. Between the sections 22A and 22B are abutment ledges 26 and 28.

The torsion member D is here shown as formed of three elongated metal rods 30 assembled with peripheral surfaces in engagement according to the teachings of the aforementioned application Ser. No. 618,897. Sleeve-like end parts 32 are loosely axially slidably mounted on the torsion member D near its ends. Hereafter only one end structure will be described, it being understood that the construction is similar at both ends.

Because the inner opening of element 32 mates with the non-circular periphery of the bunched group of rods 30 on which it is mounted, it is non-rotatable relative to that portion of the torsion member D which it engages. The outer periphery of the sleeve-like part 32 is provided with external teeth 34, the part 32 being received within the central through aperture 36 of a ring 38 with the teeth 34 engaging the internal teeth 40 of the ring 38. The ring has external gear teeth 39. All of the teeth in question may be of conventional gear teeth shape, but that is not essential, it being necessary only that the teeth of each set when engaged with one another limit relative rotation, the engagement preferably providing appreciable looseness (see FIG. 7) so that the intermeshing of the teeth can readily be accomplished when adjustment is desired.

The sleeve-like part 32 has a smooth-surfaced cylindrical end part 42 which is rotatively received within a correspondingly sized and shaped recess 44 in bushing 46, that bushing having a central aperture 48 and an axially extending part 50 with longitudinally extending external grooves 52. The sleeve C is received snugly over and rotates with the part 50 of the bushing 46, which is in turn journaled on end part 42 of part 32. While the sleeve C may take a number of forms, it is preferred, in accordance with the present invention, that it have a fluted cross-sectional shape, thus defining, extending axially along its length, outward projections 54 and inward projections 56. The arms 16 which carry the cam followers 14 are keyed to the sleeve C for rotation therewith by having apertures 58 shaped to mate with the longitudinally extending external flutes of the sleeve C formed by the projections 54 and 56. This enables the arms 16 to be slid along the length of the sleeve C to that position where, in a given installation, the cooperating cams 10 are located. In order to assist in retaining the arms 16 in their desired axial position relative to the sleeve C, the arms 16 are advantageously formed from a single metal sheet defining spaced side arms 16A connected by wall 16B which extends only partway down the length of the arm, the arm portions 16C located below the wall 16B carrying the apertures 58 which are slightly larger than the cross-section of the sleeve C. The side arms 16A are resiliently spread apart. When thus spread they firmly grasp the sleeve C and prevent the arm 16 from moving axially thereof. If adjustment of the positioning of the arm 16 along the length of the sleeve C is desired, one need merely grasp the extending ends of the arm parts 16C and push them toward one another, thus releasing the grip of those parts on the sleeve C and permitting the arm position to be adjusted. The arm parts 16C may be provided with resilient tongues 60 to facilitate axial location and adjustment. Moreover, the rotative position of the arm 16 relative to the sleeve C may be grossly adjusted within steps permitted by the fluting on the sleeve C. As here specifically disclosed there are three flutes, and hence there are three permissible relative rotative positions for the arm 16. If a greater number of flutes be provided, there will be a correspondingly greater number of possible relative rotative positions for the arms.

Although, as has been described, the sleeve C rotates with the arms 16 and the bushing 46, means must be provided for non-rotatively connecting the sleeve C to the torsion member D at points spaced from the anchored ends 4, 6 of that torsion member in order that the torsion member be twisted when relative movement occurs between the parts A and B.

To that end, slidably mounted on the torsion member D and rigidly rotatable therewith, as by having an internal aperture 61 which mates with the outer periphery of the torsion member D, and also being axially slidable with respect to but rotatable with the sleeve C, as by having an outer periphery 62 engaging the fluted interior of the sleeve C, is a part 64. The axial position of the part 64 relative to the part 46 is determined by the length of a structural member 66 received inside the sleeve C and interposed between the parts 64 and 46.

When the torsion unit is installed with the external gear teeth 39 of the ring 38 in mesh with the internally extending teeth 34 on the mounting block 18, and the cam follower 14 on the arm 16 is engaged with the cam 10 on the part B, the relative rotational position of (a) the tension device with respect to the mounting block 18 and (b) the relative rotational position of the part 32 with respect to the ring 38 will together determine the degree to which the torsion member D is twisted, and hence the magnitude and direction of the force exerted by the torsion member D on the part A. This characteristic will vary with the particular piece of apparatus with which the torsion device is to be used, but will in general be the same for all similar pieces of apparatus. Therefore when a group of torsion devices are shipped to the facility where they are to be installed, it is vitally important that all of those devices be installed (a) in the same rotative position with respect to the mounting blocks 18 and that (b) the gears 32 and rings 38 be in proper rotative position. It is also essential, if a given device is to be readily adaptable for use with different pieces of apparatus, as is most important for economical manufacture, that a standard device construction be capable of adjustment to provide the desired operative characteristics. As was pointed out in application Ser. No. 618,897, this type of adjustment is permitted through the use of the part 32-ring 38 combination, and, as shown in FIG. 7, it is preferred that the engaging sets of teeth 34, 40 and 39, 24 be provided with slightly different angular pitches. For example, as may be seen from FIG. 7, if the effective pitch of the teeth 34, 40 is 18° and the effective pitch of the teeth 39, 24 is 20°, it is possible to achieve control of the anchor position of the end of the torsion member D in 2° steps.

The meshing of the set of gear teeth 34, 40 is preferably accomplished at the factory. When that is done, means must be provided to ensure that the ring 38 stays on the sleeve-like part 32. In addition, it is highly desirable that means be provided at the factory, on the unit being shipped, to ensure that when the torsion device is mounted on the mounting blocks 18 it is in the desired rotational relation thereto, that is to say, that there must be proper engagement between the gear teeth 39 and 24.

In the embodiment of FIGS. 1–14 both of these results are achieved through the use of a retaining clip generally designated 68. That clip, perhaps best seen in FIGS. 9–12, may well be formed from a sheet of resilient metal and comprises a rear wall 70 and a front wall 72 connected by an end wall 74. The spacing between the front and rear walls 72 and 70 corresponds to the width of the ring 38 and the toothed portion of the part 32, and the front wall 72 is cut away at 76 so as to receive therein the small diameter portion 34 of the part 32, thus enabling the clip 68 to be slid in a direction at right angles to the axis of the torsion member D over the end of that member and then to resiliently grip that member. When it is thus positioned it engages both the part 32 and the ring 38 and keeps them in mesh, preventing the ring 38 from becoming disengaged from the part 32, it being understood that because the front wall 72 engages the inwardly facing surface of the toothed portion of the part 32 it cannot move axially off therefrom. Because the front wall 72 overlies both the ring 38 and the radially inner portion of the part 32, and because the rear wall 70 also overlies the ring 38 and a portion of the part 32, axial movement of the ring 38 relative to the part 32 is prevented, and hence meshing engagement between the gear teeth 34 and 40 is ensured. Thus the clip 68 ensures that once the ring 38 is engaged with the part 32 in the desired relative rotational position it will remain in that position. The front wall 72 may be provided with a central aperture 78, which, as may be seen in FIG. 9, is preferably somewhat smaller than the cross-sectional size of the torsion member D, thus axially retaining that member in position.

The clip 68 also functions to ensure that when the torsion device is mounted it will assume the proper relative rotational position. To accomplish that, as here specifically disclosed, the end wall 74 of the clip 68 is provided with an opening 78 into which one or more of the external teeth 39 of the ring 38 are received, thus fixing the relative rotational position of the clip 68 relative to the ring 38, and hence the remainder of the torsion device. Extending from the clip 68 at the top and bottom thereof are a pair of fingers 80 and 82 respectively. Those fingers cooperate with the abutments 26 and 28 respectively formed in the recess 20 to fix the rotational position of the torsion device relative to the mounting block 18.

The manner in which these parts thus function derives from the adaptability of the torsion device to facilitate mounting on the apparatus with which it is to be used, as shown in detail in FIGS. 6A–C. The recess 20 in the mounting block 18 is considerably. larger than the cross-sectional size of the torsion element with the clips 68 secured thereon. Thus the torsion element assembly can be moved axially through the recesses 20 in the mounting blocks 18 until the rings 38 at each end of the assembly are brought into line with the recesses 20 themselves. In order to accomplish this axial movement the recess sections 22A are used, as shown in FIG. 6A. Then the torsion device assembly is moved into the sections 22B of the recesses 20, preferably by first causing the fingers 80 to engage the abutment surfaces 26 and then swinging the assembly about that point of engagement from the solid line position of FIG. 6B to the broken line position thereof, and continuing that movement until the finger 82 engages the abutment surface 28 as shown in FIG. 6C. As this movement of the torsion device takes place the external gear teeth 39 on the ring 38 will progressively engage with the internal gear teeth 24 on the mounting block 18, and it is in order to facilitate attaining that engagement that the lowermost inwardly projecting teeth 24 are progressively reduced in size. Since the rotative position of the tension device is fixed with respect to the clip 68 by engagement of the teeth 39 in the opening 78, and since the rotative position of the clip 68 is fixed with respect to the mounting block 18 by engagement of the fingers 80 and 82 with the abutment surfaces 26 and 28 respectively, the mounting of the torsion device in the mounting blocks 18 ensures proper rotational relationship.

At some point in the mounting procedure, either before, during or after the movement of the torsion device to its fully mounted position shown in FIG. 6C, the cam followers 14 on the arms 16 are engaged with the cams 10. Once the device has been mounted on the mounting blocks 18 and the cams and cam followers have been thus engaged, torsion member D will be twisted and thus will exert a torsional force on the torsion member assembly. This force will be in a direction to tend cause the assembly to move in the same direction that it has moved in going form the position of FIG. 6A to the position of FIG. 6C. Hence the action of the torsion element D ensures that the unit will remain in its mounted position.

The embodiment of FIGS. 15–19 differs from that of the preceeeding embodiment in the construction of the part which retains the ring 38 on the sleeve-like part 32 and which ensures that the torsion assembly when mounted on fixed part A is in proper rotational relationship thereto. In the main the parts of the torsion assembly in this embodiment are the same as those in the preceeding embodiment, similar reference numerals are applied thereto, and no additional description thereof is required. It should be noted, however, that the ring 38′ of this embodiment, while otherwise similar to the ring 38 of the first-described embodiment, is provided radially inside the outwardly extending teeth 39 with an axially outwardly facing ledge 101. It should also be noted that in this second embodiment the recess 20′ in the mounting block 18′ is defined by a circular ring of internally extending teeth 24 of uniform shape, with gaps 103 and 105, here shown as diametrically opposed, defined respectively by the omission of an internal tooth 24.

The element in the embodiment of FIGS. 15–19 which performs the functions of the retaining clip 68 of the earlier described embodiment, that is to say, which retains the ring 38′ on the torsion member in proper rotational position and which ensures that the torsion assembly when mounted on themounting block 18 is in proper rotational position relative thereto, is a ring generally designated 107 which is mounted on the cylindrical end part 42 of the sleeve-like part 32 between the part 50 of the busging 46 and the external gear teeht 34 of the sleeve-like part 32, as can perhaps best be seen from FIGS. 16 and 17. The ring 107 is thus positioned by being slipped onto the end part 42 before that end part is forced into the recess 44 in bushing 46. The compactness of the subassembly thus produced, shown as the left-hand element in FIG. 16, is ensured by the mating axially outwardly facing inclined surface 109 on the ring 107 and the axially inwardly facing inclined surface 111 on the teeth 34. Formed integrally as a part of the ring 107 are a pair of axially extending fingers 113 and 115 terminating in radially inwardly extending protuberances 117 and 119 respectively. The width and radial extent of the fingers 113 and 115 are such that they are relatively snugly received between a pair of adjacent external gear teeth 39 on the ring 38′, the fingers 113 and 115 having a length such, and the protuberances 117 and 119 being so located, as to snap over the ledges 101 formed in the ring 38′. Thus when the ring 38′ is properly rotatably positioned with respect to the end part 32 it is pushed axially onto that end part, the internal gear teeth 40 on the ring 38′ meshing with the external gear teeth 34 on the end part 32, the fingers 113 and 115 interposing themselves bwtween appropriate pairs of external gear teeth 39, until the protuberances 117 and 119 have snapped over the ledges 101. Once this has been done the ring 38′ is effectively retained in proper rotative position and is prevented from sliding off the torsion member. The torsion member with the ring 107 as part thereof may therefore be shipped as a unit to the point of use with assurance that the ring 38′ will remain properly positioned thereon.

When the unit arrives at its point of use it is mounted on the mounting block 18 simply by first axially moving the unit so that the ring 38′ at one end enters the recess 20′ of the mounting block 18′ at that end, the proper rotative position of the ring with respect to the mounting block 11 being received fixed or keyed by the presence of the fingers 113 and 115 between two sets of adjacent external ring teeth 39, those fingers and the teeth adjacent thereto fitting only into the gaps 103 and 105 in the gear teeth 24 projecting inwardly into the recess 20′ of the mounting block 18′. After one end of the unit has been thus mounted in one of the mounting blocks 18′, which may already have been secured in place on the part A, the other end of the unit is correspondingly associated with the other mounting block 18′, that block being moved axially onto the other end of the unit and the appropriately secured to part A. It is quite feasible to have this second mounting block 18′ preliminarily loosely secured to the part A before it becomes associated with the torsion unit so as to enable it to be moved onto the ring 38′ at that end of the rorsion unit and then securely fastened to the part A.

Absolute rotational keying of the unit with respect to the mounting block 18′ could be acheived using but a single finger 113 or by so circumferentially locating the fingers 113 and 115 that they are not diametrically opposed to one another. Providing the two fingers 113 and 115 in diametrically opposed relationship, as here specifically disclosed, is advantageous from a manufacturing and assembly point of view, but does not leave the keying of the unit with respect to the mounting blocks 18′ somewhat ambiguous, since it permits mounting of the unit on the mounting blocks 18′ in either of two positions 180° removed from one another. However, since the unit will usually be shipped with the cam-follower arms 16 already in place, their location will remove any such ambiguity in the rotational position of the unit relative to the mounting block blocks 18.

Thus the fingers 113, 115 together with their protuberances 117, 119 perform the dual functions of (a) retaining rings 38′ in axial position on the part 32, the geared relationship between the ring 38′ and the part 42 thus ensuring proper relative rotational positioning between those parts, and (b) ensuring that when the unit is mounted on the mounting blocks 18 it assumes its desired rotational position relative to those mounting blocks.

It will be apparent from the above that by means of the disclosed structure a torsion device can be mounted on the apparatus with which it is to be used in an extremely simple manner and without requiring any drilling or lining up of holes, or use of external attaching structure, and that the mounting can be accomplished simply by moving the device into place and without requiring access to remote or hard-to-reach parts. In addition, torsion devices capable of having a wide variety of "tailor-made" torsional effects produced from a single standardized structure can be appropriately put together in the manufacturing plant and then shipped to the location where they are to be installed, and the same facile installation method will accomplish the desired "tailor-made" torsional effects.

While but two embodiments of the present invention have been here specifically disclosed, and in connection with a specific construction for a torsional device, it will be apparent that the invention is not limited thereto, but that many variations may be made therein, all within the scope of the present invention as defined in the following claims:

I claim:

1. In combination, a torsion bar assembly and mounting means therefor, said torsion bar assembly being adapted to resiliently affect relative movement of first and second parts and comprising a torsion element one point of which is operatively connected to a member having externally projecting teeth and another point of which is operatively connected to means adapted to be in turn operatively connected to said first part, said mounting means comprising a structure operatively connected to said second part and defining a recess with inwardly projecting teeth formed in at least a portion of its periphery, said recess being so sized and shaped that said member can freely enter said recess and can then be moved at least in part in the direction that its teeth project to an engaged position in which its teeth engage with the teeth formed in the periphery of said recess.

2. The combination of claim 1, in which the teeth of said member extend along a pitch circle and said recess has a length of teeth at the upper portion thereof extending along a pitch circle segment generally corresponding to the pitch circle of said member, the lower portion of said recess opening out radially beyond said pitch circle, whereby said member can be moved into engaged position in said recess with a motion involving rotation or swinging after the teeth on the upper portion of said member have engaged the teeth at the upper portion of said recess.

3. The combination of claim 2, in which said recess teeth extend along at least a portion of the side of said recess as well as along the upper portion thereof.

4. The combination of claim 3, in which the lower recess teeth are distorted to facilitate said rotation or swinging movement of said member into engaged position.

5. The combination of any of claims 2–4, in which the direction in which said member is rotated or swung to bring it into engaged position in said recess is the same as the direction in which said torsion element exerts its resilient force on said member when said first and second parts are relatively positioned to twist said torsion element.

6. In the assembly of any of claims 1–4, in which said member is located adjacent an end of said torsion element, an element at least partially fitting over and non-rotatively engageable with said member and having parts engageable with said mounting means when said member is in engaged position within said recess.

7. In the assembly of any of claims 1–4, in which said member is located adjacent an end of said torsion element and is adapted to be located in a predetermined relative rotational position with respect thereto, an element at least partially fitting over and non-rotatively engageable with said member and having parts engageable with said mounting means when said member is in engaged position within said recess, thereby to ensure that said predetermined relative rotational position is attained.

8. In the assembly of any of claims 1–4, in which said member is located adjacent an end of said torsion element and is adapted to be located in a predetermined relative rotational position with respect thereto, an element at least partially fitting over and non-rotatively engageable with said member and having parts engageable with said mounting means when said member is in engaged position within said recess, thereto to ensure that said predetermined relative rotational position is attained, said element having front and rear walls connected by an end wall, said front and rear walls being cut away to receive those portions of said assembly axially in front of and behind said member, whereby said element is slidable onto said member from the side of the latter so as to extend over at least parts of the front and rear surfaces of said member, and said end wall has an opening into which at least one tooth of said member is received.

9. The combination of any of claims 1–4, in which said member has internal gear teeth and is axially slidable onto and into meshing engagement with an inner gear which is non-rotatively connected to said torsion element, and an element laterally slidable onto said member and having front and rear portions which at least partially cover the mesh between said member and said inner gear, thereby to retain said member on said inner gear.

10. The combination of claim 9, in which said member is located adjacent an end of said torsion element, and said element is non-rotatively engageable with said member and has parts engageable with said mounting means when said member is in engaged position within said recess.

11. The combination of claim 9, in which said member is located adjacent an end of said torsion element and said element is non-rotatively engageable with said member and has parts engageable with said mounting means when said member is in engaged position within said recess, said element having front and rear walls connected by an end wall, said front and rear walls being cut away to receive those portions of said assembly axially in front of and behind said member, whereby said element is slidable onto said member from the side of the latter so as to extend over at least parts of the front and rear surfaces of said member, and said end wall has an opening into which at least one tooth of said member is received.

* * * * *